US007607935B2

(12) United States Patent
Dahl

(10) Patent No.: US 7,607,935 B2
(45) Date of Patent: Oct. 27, 2009

(54) INSERT WITH VENTILATION

(75) Inventor: Torben Dahl, Silkeborg (DK)

(73) Assignee: Daxtor ApS, Silkeborg (DK)

( * ) Notice: Subject to any disclaimer, the term of this patent is extended or adjusted under 35 U.S.C. 154(b) by 218 days.

(21) Appl. No.: 10/583,205

(22) PCT Filed: Aug. 26, 2004

(86) PCT No.: PCT/DK2004/000567

§ 371 (c)(1),
(2), (4) Date: May 23, 2007

(87) PCT Pub. No.: WO2005/059435

PCT Pub. Date: Jun. 30, 2005

(65) Prior Publication Data

US 2007/0249183 A1 Oct. 25, 2007

(30) Foreign Application Priority Data

Dec. 16, 2003 (DK) ..... 2003 01863

(51) Int. Cl.
*F21V 29/00* (2006.01)

(52) U.S. Cl. ..... 439/485; 439/558; 362/96; 362/149; 362/373

(58) Field of Classification Search ..... 439/485, 439/558, 557; 362/149, 373, 96
See application file for complete search history.

(56) References Cited

U.S. PATENT DOCUMENTS

| | | | | |
|---|---|---|---|---|
| 3,068,341 | A | 12/1962 | Ortiz et al. | |
| 3,573,715 | A * | 4/1971 | De Lano | 439/558 |
| 3,614,713 | A * | 10/1971 | Heath | 439/558 |
| 3,641,481 | A * | 2/1972 | Farrell | 439/558 |
| 5,380,208 | A * | 1/1995 | Ying | 439/558 |
| 5,458,505 | A * | 10/1995 | Prager | 439/485 |
| 5,664,872 | A * | 9/1997 | Spearman et al. | 362/96 |
| 6,095,671 | A | 8/2000 | Hutain | |
| 6,168,299 | B1 * | 1/2001 | Yan | 362/365 |
| 6,619,983 | B2 * | 9/2003 | Ota et al. | 439/558 |

FOREIGN PATENT DOCUMENTS

| | | |
|---|---|---|
| EP | 0 840 060 A | 5/1998 |
| FR | 1304849 | 9/1962 |
| FR | 2669098 | 5/1992 |
| GB | 2230591 | 10/1990 |
| WO | WO 92/05389 | 4/1992 |

* cited by examiner

*Primary Examiner*—Gary F. Paumen
(74) *Attorney, Agent, or Firm*—James Creighton Wray; Meera P. Narasimhan

(57) ABSTRACT

It is an object of the present invention to provide an insert (1) suitable for being placed in a wall, ceiling or other element wherein an electrical installation means such as a lamp socket or the like may be fitted. Ventilation means (6) are provided inside the insert (1) such that an air current may be created and further that the air current may be led past the electrical installation (15), such that the overall heat accumulation inside the device may be drastically reduced.

15 Claims, 8 Drawing Sheets

INSERT WITH VENTILATION

This application claims the benefit of Danish Application No. PA 2003 01863 filed Dec. 16, 2003 and PCT/DK2004/000567 filed Aug. 26, 2004, which are hereby incorporated by reference in their entirety.

BACKGROUND OF THE INVENTION

The present invention relates to an insert suitable for being placed in a wall, ceiling or other element.

When mounting electrical equipment in wall, ceilings or other elements such as for example kitchen cupboards, book cases, shelves and the like, it is customary to arrange a box inside a cavity made in said element. The electrical wiring is usually led via appropriate piping systems to the connection boxes whereafter electrical equipment such as lamps, switches etc. are arranged, for example as a cover for the electrical connection box. Especially for lamps, the socket is usually arranged in a wire extending through an aperture in the lid of the electrical connection box, such that there is a physical distance between the electrical connection box and the socket for the lamp. For other types of lamps, especially for the so-called built-in spotlights, a ceiling spaced from the lower side of the horizontal division between two floor is provided. In the ceiling holes are drilled wherein the spots are arranged. On top of the ceiling the wiring is led to connection boxes attached to the underside of the horizontal division, whereby the built-in spots may be supplied with electricity. An example of such a connection box is disclosed in U.S. Pat. No. 6,168,299.

In buildings where a lowered ceiling cannot be provided, special implements may be inserted on the backside of the ceiling in order to accommodate the built-in spotlights. A number of factors must be taken into consideration when providing such a construction. Among others, the insulation placed immediately adjacent the ceiling as well as the humidity membrane has to be taken into consideration and appropriate measures taken in order for the humidity membrane to stay intact, and also for the insulation to be arranged properly around the build-in spotlight holder.

An additional problem concerning built-in spotlights in particular is generation of heat from halogen light sources which are predominant in the interior design, especially of stores and shops. In order to minimise the fire hazard, it is desirable to make sure that the temperature behind the halogen light source does not reach a level where ignition of combustible materials in the vicinity of the built-in halogen spot becomes a real risk. Usually, manufacturers of the halogen built-in spotlight devices advise that combustible materials should not be placed within 50 cm of such a device in order to avoid fire hazard. For some suppliers of electrical equipment, the corresponding requirements is that the temperature in the vicinity of the electrical equipment should not be allowed to rise above 90° C. in order not to damage the electrical equipment and thereby rendering the electrical equipment the source of a fire hazard.

A prior art device comprising means for cooling the electrical equipment is known from U.S. Pat. No. 5,664,872. This device comprises two sections with are to be coupled such that first the electrical connections are completed and afterwards a fan unit is fitted to the connection box, whereby activation of the fan causes air to pass by the electrical installation. The connection box is adapted to be screwed into for example a ceiling, and then the light fixture will be mounted by means of a collar which collar is to be snap fitted onto the flange of the connection box, in order to provide the finishing touch necessary for this kind of installations when installed into an interior decoration scheme. The installation requires a number of parts, and furthermore once the connection box and the electrical connections are arranged it is impossible to access the fan unit from below the ceiling. Thereby cleaning and maintenance of the unit is severely hampered as a complete demounting of the unit is required in order to gain access to the unit.

SUMMARY OF THE INVETION

It is consequently an object of the present invention to provide an insert suitable for being placed in a wall, ceiling or other element wherein an electrical installation means such as a lamp socket or the like may be fitted, without this insert causing any of the problems or risks as mentioned above.

The present invention addresses this problem by providing an insert of the kind mentioned above wherein said insert comprises ventilation means and an aperture in which, inside the insert, means for snap-fitting of electrical installation means, such as a lamp socket, connection box, halogen light fitting or the like, are provided, and furthermore that resilient means are provided for fastening of the insert in said wall, ceiling or other element.

By providing ventilation means inside the insert such that an air current may be created and further that the air current may be led past the electrical installation, the overall heat accumulation inside the device may be drastically reduced. The cooling or ventilation air will enter the insert through the aperture in the insert, which is also adapted to receive the electrical installation or the like. Thereby, the provisions necessary in order to minimise the fire hazard may be avoided altogether. This in turn makes it possible to install the insert very easily into the types of elements mentioned above, without necessitating the special and often cumbersome and expensive precautions associated with in particular the arrangement of built-in spotlights, such as keeping combustible materials at a distance of 50 cm from the object and providing sufficient free space behind the built-in spot in order to avoid the build-up of heat, etc or necessitating access from behind the surface into which the insert is to be build into.

The provision of resilient means for fastening the insert, does not necessarily need special tools, as in some embodiments the resilient means will be deflected when placing the insert and after the insert has reached its final position the resilient means will flick back into the original position and in this manner maintain the insert in position.

Furthermore, by providing resilient means, whether or not in the shape of spring like elements or as integrated deformable elements or sections in the insert, a firm and furthermore adaptable fastening method is provided. As the circumstances concerning the building components may vary from installation site to installation site, the advantageous provision of resilient means, i.e. adaptable fastening means, provides the possibility for reliable mounting of the insert in various materials and various circumstances. Thereby the risk of errors during installation is greatly reduced.

In an alternative further advantageous embodiment the resilient means built into the insert, is an expansion unit made up of two coaxially arranged cylindrical elements which include at least three zones in axial direction:

- a first zone that in the assembled condition will be farthest from the surface on which the item is mounted and at the inner side of which is provided engagement means;
- a deformation zone in which there is provided pre-shaped deformation means, whereby the item, when subjected to axial deformation, will expand the cylindrical cross-section compared with the cross-section of the cylinder before the deformation; and a spacer zone;

and where the inner cylindrical element includes at least two zones:

a first zone in which at the outer side of the cylinder there is provided engagement means corresponding to and intended for engagement against the engagement means of the outer cylinder;

a second spacer zone.

This construction ensures that the expansion unit achieves very great flexibility and good fastening in or to the plate or the item in which it is to be mounted. The corresponding engagement means may e.g. have the shape as reversed barbs or triangles, respectively, whereby a secure relative locking of the two elements is ensured when the inner cylindrical element is inserted in the outer and the engagement means are thus engaging.

The outer element is made up of three zones, a first zone which in the mounting condition is farthest away from the surface. The axial extension of this zone may vary from application to application, as in cases where additional equipment, such as electric connector elements, switches and the like are to be mounted coaxially within the expansion unit, the first zone may advantageously be made with a certain extension in axial direction. In other embodiments, where the expansion unit is used for holding two plate sections against each other or in another way where one does not desire to utilise the space within the cylinder, the first zone may be made so that it just fulfils the requirements that may be to strength with regard to material thickness.

Besides, it is naturally to be considered that the first zone has an axial extension allowing that necessary engagement means are provided at the inner side of the cylindrical unit.

The deformation zone has an extension in axial direction, which is large enough so that when the unit is loaded in axial direction, deflection of the deformation elements will occur, the deflection being necessary in order to hold the expansion unit solidly in the mounted condition. The deformation means may be made by indentations being made in the wall material whereby is indicated where the item is to bend out under the axial load. Depending on which type of material is the case, these grooves in the material may be designed so that deformation occurs at a given load simultaneously with the unit maintaining necessary material thickness for remaining intact during and after expansion. The extension of the deformation zone in axial direction is determined in dependence of how much the deformation elements are to project beyond the circumference of the unit.

The deformation elements may also be in the form of flaps which have been given a pre-deflection. When inserting the insert/unit in an element such as a ceiling, the flaps will be squeezed together due to the size of the aperture in the ceiling and when the flaps have passed the ceiling thickness, they will expand due to the pre-deflection induced into these flaps.

The spacer zone serves to provide a certain distance between the surface in which the expansion unit is to be mounted and the engagement of the deformation means in the structure in which the expansion unit is to be mounted. Where the expansion unit is to be mounted in a plate, the spacer zone will typically have an extension in axial direction corresponding to the plate thickness. Hereby is ensured that the deformation means are causing deformation and expansion in the unit, whereby the deformation elements project from the back side of the plate and bear on the back side of the plate. This ensures a very stable mounting of the expansion unit in the plate item.

The inner cylindrical element includes at least two zones. The first zone is made with engagement means corresponding to the engagement means at the inner side of the first element so that when the inner element is pushed coaxially into the outer element, it is possible to bring the two sets of corresponding engagement means into engagement, respectively, whereby the two cylindrical elements are secured relatively to each other. The second zone is a spacer zone corresponding to the spacer zone provided in the outer cylindrical element for the same reasons.

In a further advantageous embodiment of the insert according the present invention, a ventilation means is arranged at the end of the insert opposite the aperture. By arranging the ventilation means in the end of the insert opposite to where the aperture is arranged, the interior of the insert is completely free and therefore any electrical installation may be installed without any interference from the ventilating means.

In a further advantageous embodiment, the end of the insert comprises one or more apertures for letting air in or out of the insert. In order for the insert to be able to compensate for the differences in pressure arising due to the ventilating means, apertures may be provided such that the inside of the insert is in communication with the ambient air.

In a further advantageous embodiment of the invention, the ventilations means is a ventilator comprising a fan and that optionally the current supply to the electrical installation also supplies current to the ventilation means.

In addition to a fan cooling ribs, for example aluminium ribs, may be provided. Although condensation often occurs due to the cold aluminium surfaces, the air current created by the fan will transport away any moisture, whereby condensation problems are avoided.

For low voltage installations such as for example 12 or 24 volt, it is possible to buy fans with a very low power consumption which will be able to provide a sufficient air current around the electrical installation in order to provide a cooling effect. The power consumption is negligible in comparison to the power consumption by the light sources and, additionally, the extra heat generated by the fan is also insignificant in comparison to the cooling air current which may be led through the inside of the insert. For other voltages such as 110 volt or 230 volt, either appropriate fan means or a transformation means may be inserted in the circuit such that the fan is provided with the appropriate current and voltage. By this arrangement it is foreseen that no extra installations or actions are necessary in order to be able to provide the ventilation means with a power supply in that the insert is especially adapted to use with electrical installations and therefore means for providing the electrical power will be present in the insert and thereby available for powering the fan.

In a further advantageous embodiment the side of the end facing away from the aperture is supplied with distance keeping means as for example legs, protrusions, netting basket or the like. In instances where the insert according to the invention is installed in ceilings where the ceiling construction comprises the visible ceiling cladding behind which a humidity barrier is arranged, behind which the insulation is arranged, for example a soft glass wool, the insert is provided with distance keeping means such that it will be possible to make air available to the fan in order to create the cooling air stream down through the insert in order to cool the electrical installation provided inside the insert.

The distance keeping means may also comprise a filter such that dust and other particles are not transported into the room through the insert.

By arranging a fan, for example a low voltage fan comparable to the fans commonly used in order to cool personal computers, an advantageous embodiment may be achieved. These types of fans have a projected life expectancy of up till 200,000 hours at constant load at 70° C. Tests with the present invention have shown that in a set-up where a 35 W halogen light source of the Osram Decostar type was arranged inside the insert, the temperature above the light source, where the light source was connected to the wiring, reached about and stabilised at 91° C. for the said 35 W halogen light source. By installing a fan of the type mentioned above used in personal computers, the temperature immediately adjacent the light source was reduced to 54.6° C. and around the caballing the temperature was measured and stabilised around 32 ° C. The temperatures measured were, after the initial heat-up period, stable for the duration of the test which lasted more than four hours.

The lowering of the temperature has a number of advantageous effects. First of all, the life expectancy of the light source may be increased and at the same time the fire hazard immediately adjacent the installation is reduced dramatically. Furthermore, by arranging the fan such that the air current is directed into the room where the light is emitted, the heat produced by the light source and the fan is ventilated into the room and may therefore be used for heating purposes. Furthermore, as warm air is lighter than cold air, the warm air produced in order to provide a comfortable temperature in the living zone may be lowered in that the light source, due to the fans, will create a circulation of the air immediately adjacent the ceiling such that the warm air gathering along the ceiling will be forced downwards due to the air streams created by the cooling fans.

In a still further advantageous embodiment of the invention the insert is provided with means for attaching the electrical installation means, and that further means are provided for allowing the air stream created by the ventilation means to pass the electrical installation means.

The invention will now be explained in detail with respect to the accompanying drawing, wherein

DETAILED DESCRIPTION OF THE PREFERRED EMBODIMENTS

Figure 1:
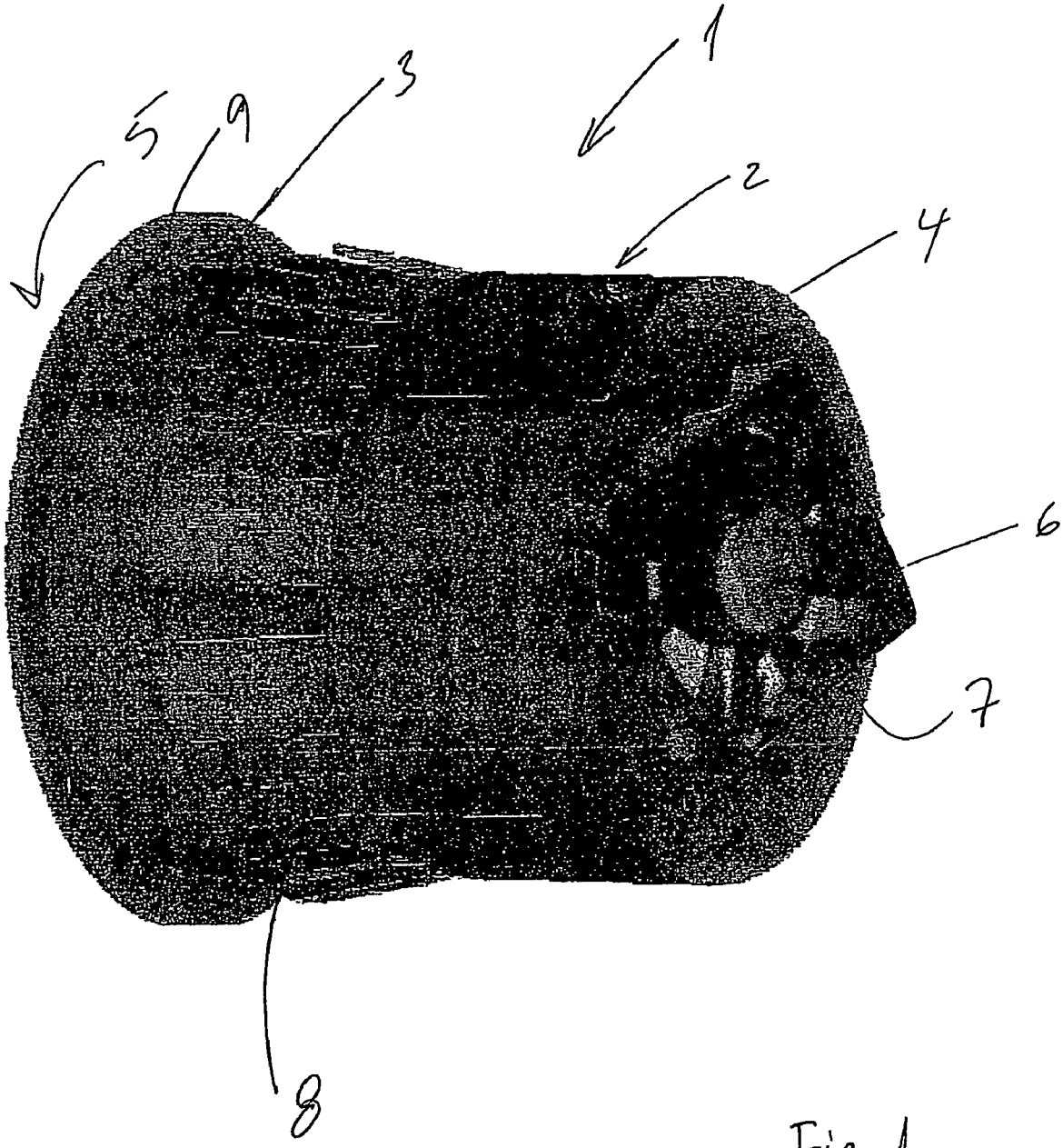
FIG. 1 shows a schematic presentation of an insert.

An insert according to the invention is illustrated in FIG. 1. The insert 1 is in this embodiment an expansion unit made up of two coaxially arranged elements 2,3. The end 4 of the insert is opposite an aperture 5 allowing access to the inside of the insert 1. In the end 4 a ventilating means 6 is arranged. In this embodiment the ventilating means comprises a fan having a number of wings 7.

Figure 2:
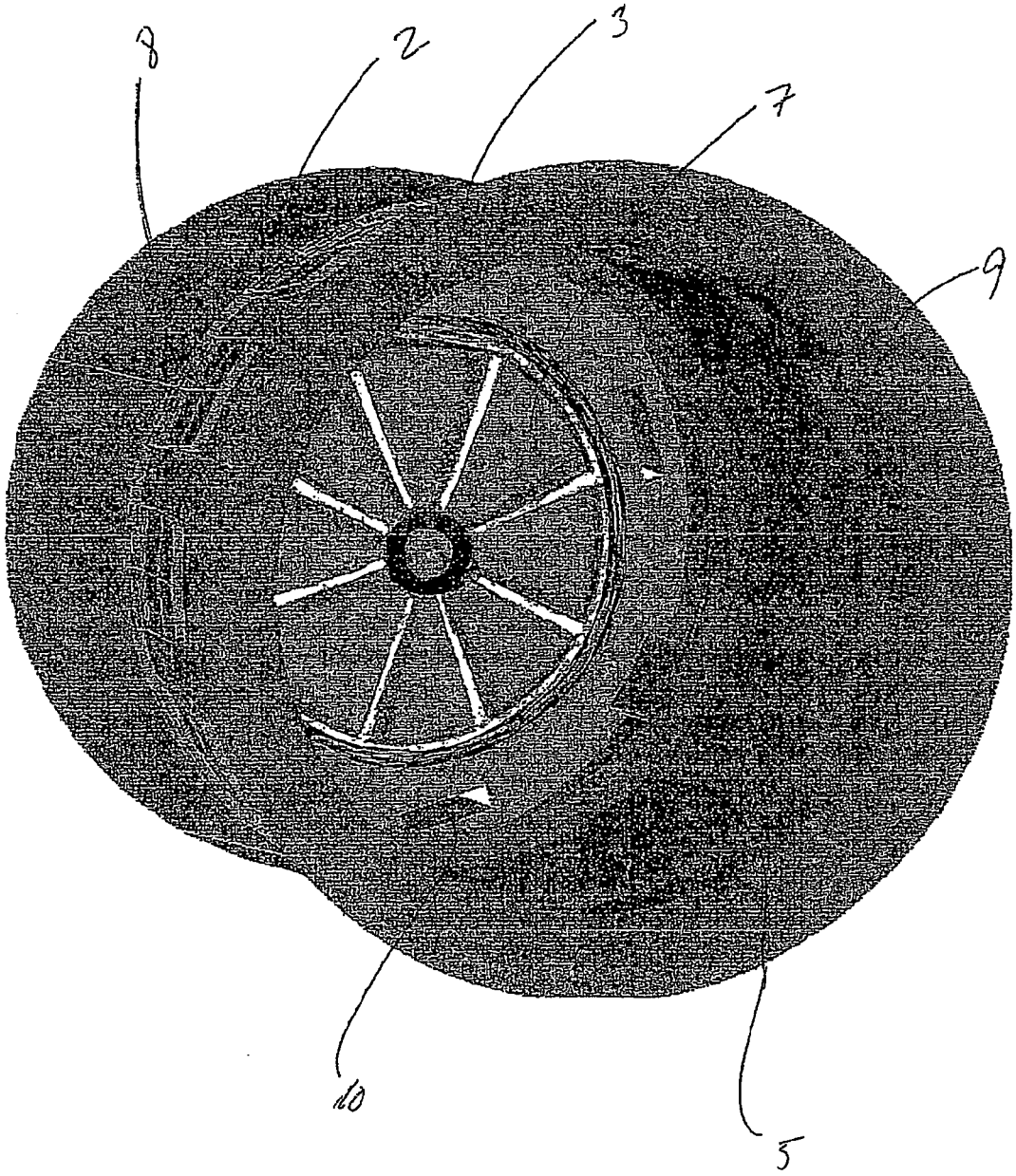
FIG. 2 shows the interior of the insert seen from below.

In FIG. 2 the insert is illustrated from below such that a view is allowed through the aperture into the interior of the insert. The reference numbers correspond to reference numbers from FIG. 1.

By using the expansion unit as insert, the insert may be installed in a very simple manner in that first an aperture is made in the ceiling, whereafter the unit is inserted through the aperture. A special tool (illustrated in FIG. 4) is inserted in appropriate fastening means in the cylindrical element 2. By pulling the cylindrical element 2 by means of the special tool toward the cylindrical element 3, deformation zones or deformation elements 8 provided in the cylindrical element 2 will deform and thereby provide a firm fastening between a rim 9 provided on the cylindrical element 3 and the deformable elements 8 which will grip around the ceiling. Thereafter, the electrical installation, for example a light socket, connection box or the like, may be installed inside the insert 1. Appropriate means 10 may be provided in order to fasten the electrical means inside the insert. In this embodiment the means are illustrated as slots 10, but any type of means, for example protrusions, clips, apertures or the like provided in the wall of the cylindrical elements may also be contemplated.

Figure 3:
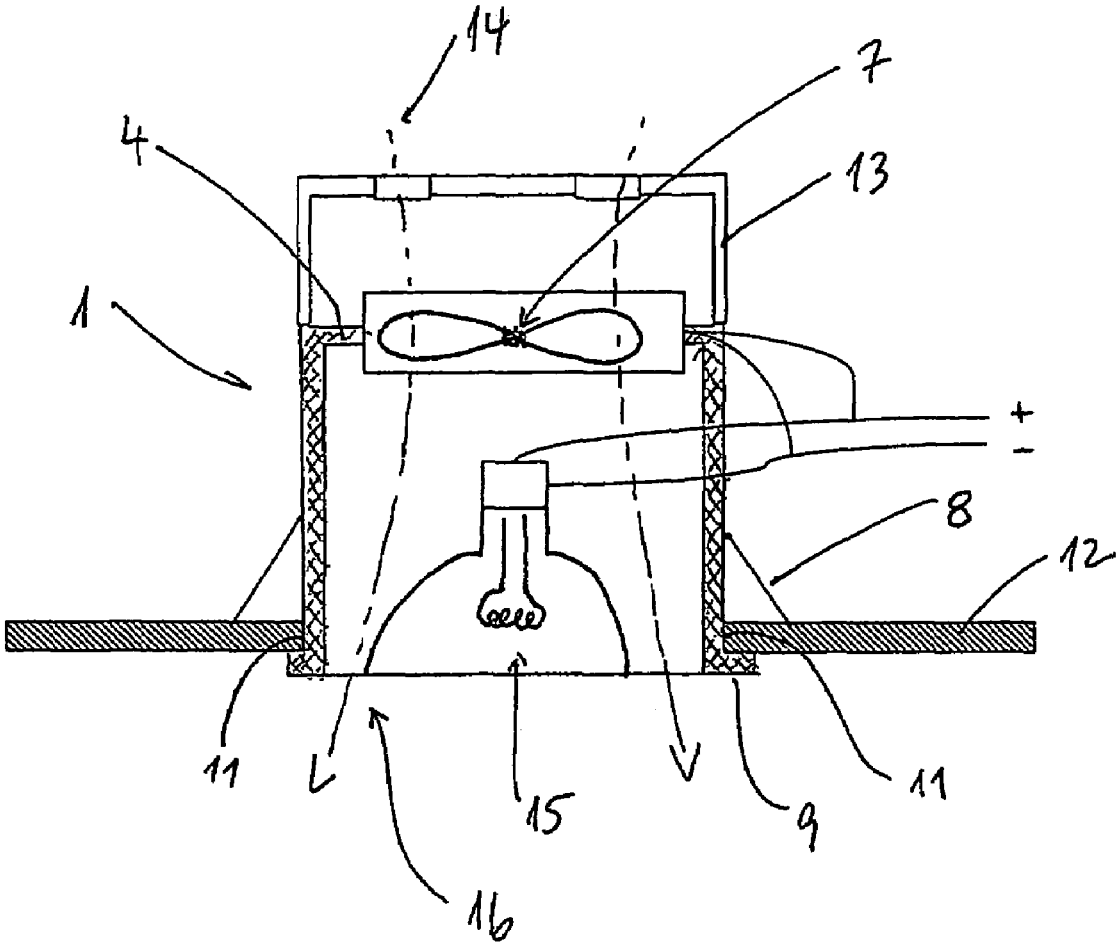
FIG. 3 shows a cross-section through an insert in its mounted position.

Turning to FIG. 3 a cross-section through an insert according to the invention is illustrated as being inserted through a plate member. The insert 1 is arranged in an aperture limited by the edges 11 of a plate member 12. The insert is fixed by deforming the elements 8 such that tension is created around the plate member 12 between the rim of the insert 9 and the deformable elements 8 of the cylindrical element 2. The fan 7 is illustrated as being mounted in the end 4 of the insert 1. In order to provide a free space about the fan 7, a perforated box 13 is provided connected to the end 4 of the insert 1. Thereby a volume comprising nothing but air is created immediately adjacent the fan 7. By connecting the fan 7 electrically to a source of energy as illustrated, the fan will create an air current as illustrated by the arrows 14. This air current will move through the insert 1 and create an air current/flow around the light source 15 such that a cooling effect will occur inside the insert 1. At the same time, the air flow 14 will be heated such that the heat generated by the light source 15 will be re-used for room heating of the room in which the light source is mounted. Accordingly, appropriate apertures 16 are provided between the light source and the inner wall of the insert 1 such that the air current 14 may escape through the front of the insert/light source.

FIG. 3 shows perforated box 13 which is formed as a protrusion. It may be formed as a netting. It may be formed as legs.

The fan type used in the device corresponds to the ventilation means for a personal computer, which is known to exhibit a long service life, low power consumption and a very low noise level. The noise will be further reduced in that a main part of the noise will be absorbed by the surrounding insulation as illustrated in FIG. 4.

Figure 4:
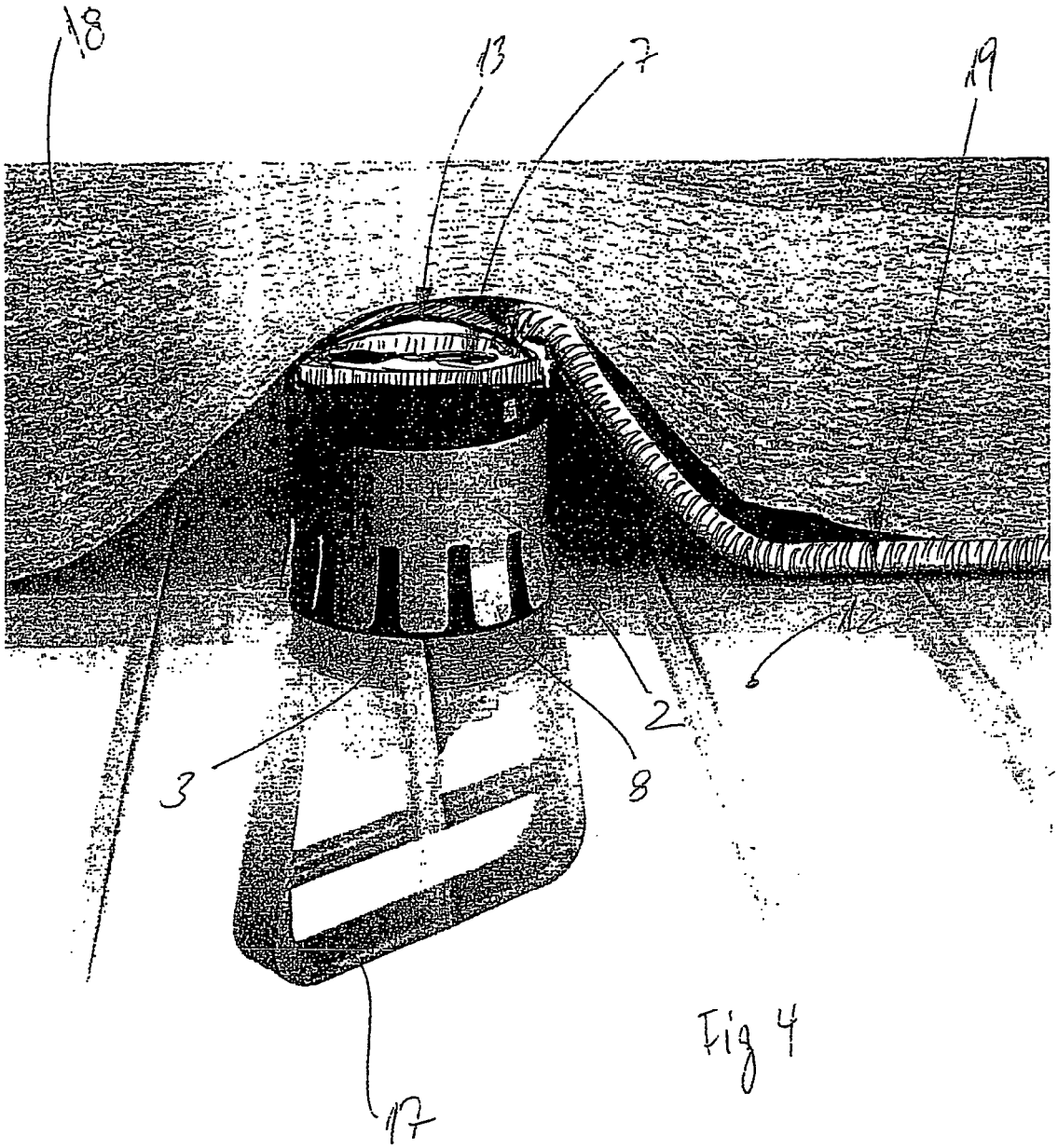
FIG. 4 shows an isometric view of an insert mounted in a ceiling.

In FIG. 4 the ceiling 12 is illustrated as semi-transparent in order to be able to see the special tool 17, which may be used advantageously in order to squeeze the two coaxially arranged cylindrical parts together around the plate member 12 as explained with reference to FIG. 3. Furthermore, a soft insulation layer 18 is illustrated as partly covering the insert 1. By further having the bracket 13 arranged across the end of the insert in order to provide a free air volume around the fan 7, it is assured that the fan will be able to provide the air stream 14, as discussed above with reference to FIG. 3.

The electrical installation is in this figure illustrated by the piping 19, which both supplies power to the light source 15 and the fan 7.

Figure 5:
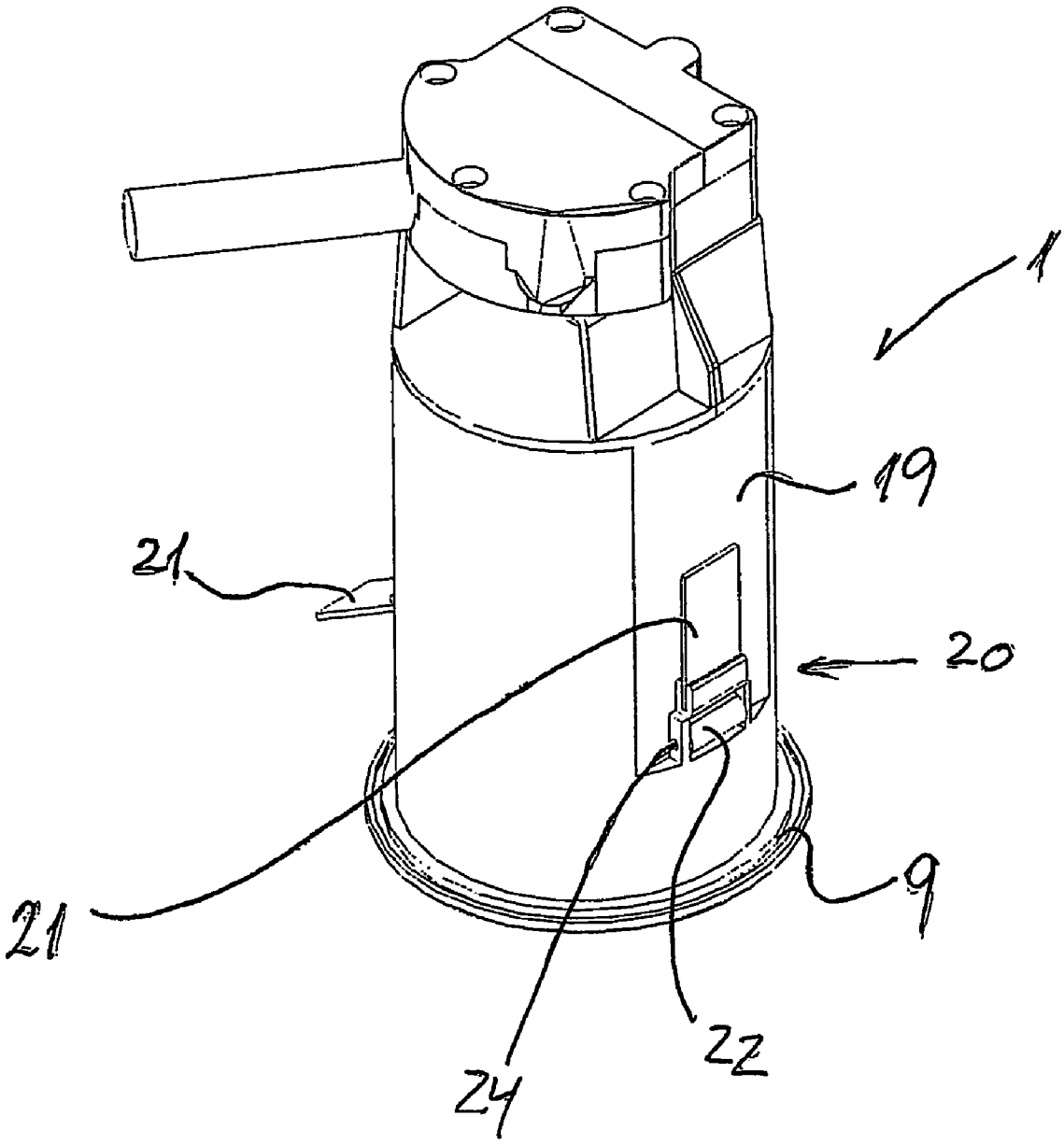
FIG. 5 shows a further embodiment of the insert.

In FIG. 5 another embodiment of the insert according to the invention is illustrated. The insert 1 is here illustrated from slightly above. The rim 9 or flange is provided in order to arrange the insert 1 in relation to a surface of a building part (not illustrated) in which the insert is to be installed.

In a recess 19 provided in the wall of the insert 1, a pivotable resilient member 20 is arranged. In this embodiment the member 20 has three sections, of which two 21,22 may be seen in this figure. The central section 22 is arranged with a pin 24 such that the member 20 may pivot in relation to the wall of the insert 1. Inside the insert 1 (not visible—see FIG. 6) the third section 23 is connected to the central section 22, through an aperture provided in the wall of the insert 1. The section 21 may be made from the same material as the rest of the pivotable member, but may also as illustrated be made from a strip of metal, preferably spring steel, which in addition to providing excellent resilient properties also is very resistant to fire. By arranging the steel in a plastic member the heat conducting bridge is disconnected, so that heat whether from outside of the insert or from the inside of the insert will not be conducted through the pivotable member.

Figure 6:
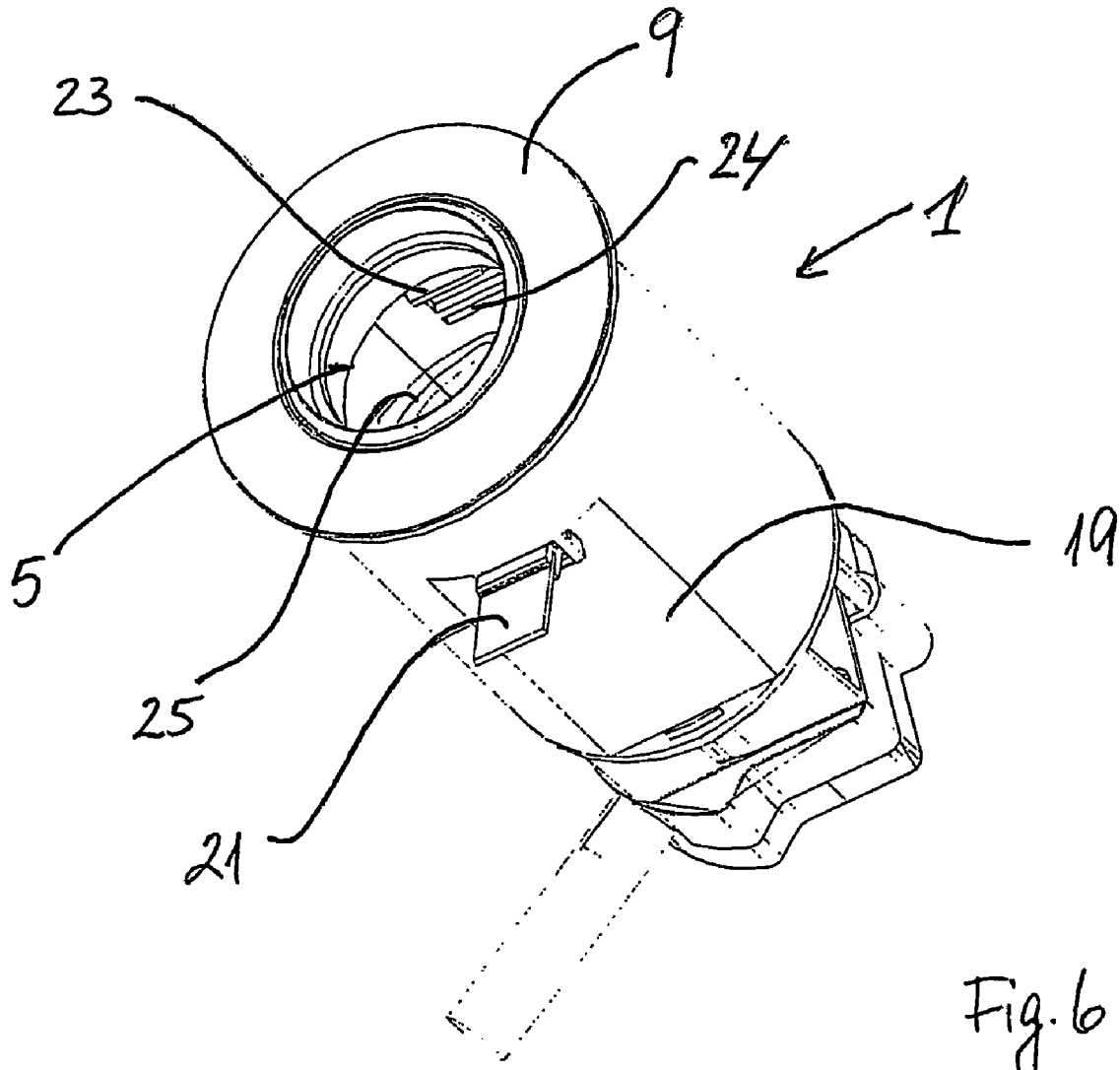
FIG. 6 shows the insert of FIG. 5 from a different angle.

In FIG. 6 the insert of FIG. 5 is illustrated such that the interior of the insert 1 may be seen. The third section 23 will as it is pivoted, i.e. the first section is away from the recess 19 in the wall of the insert 1, engage and be firmly held by the slit or recess 24, provided in the interior of the wall of the insert 1. When the resilient member 20 is in the position where the section 21 is inside the recess 19 the third section 23 will project out into the interior space of the insert. By manually pushing the third section 23, for example through the aperture 5, the first section 21 may be brought into engagement with the construction in which the insert is to be arranged.

Furthermore, the means for snap-fitting electrical installation means is in this embodiment in the shape of grooves and ridges 25 provided on the interior surface of the wall of the insert 1.

Figure 7:
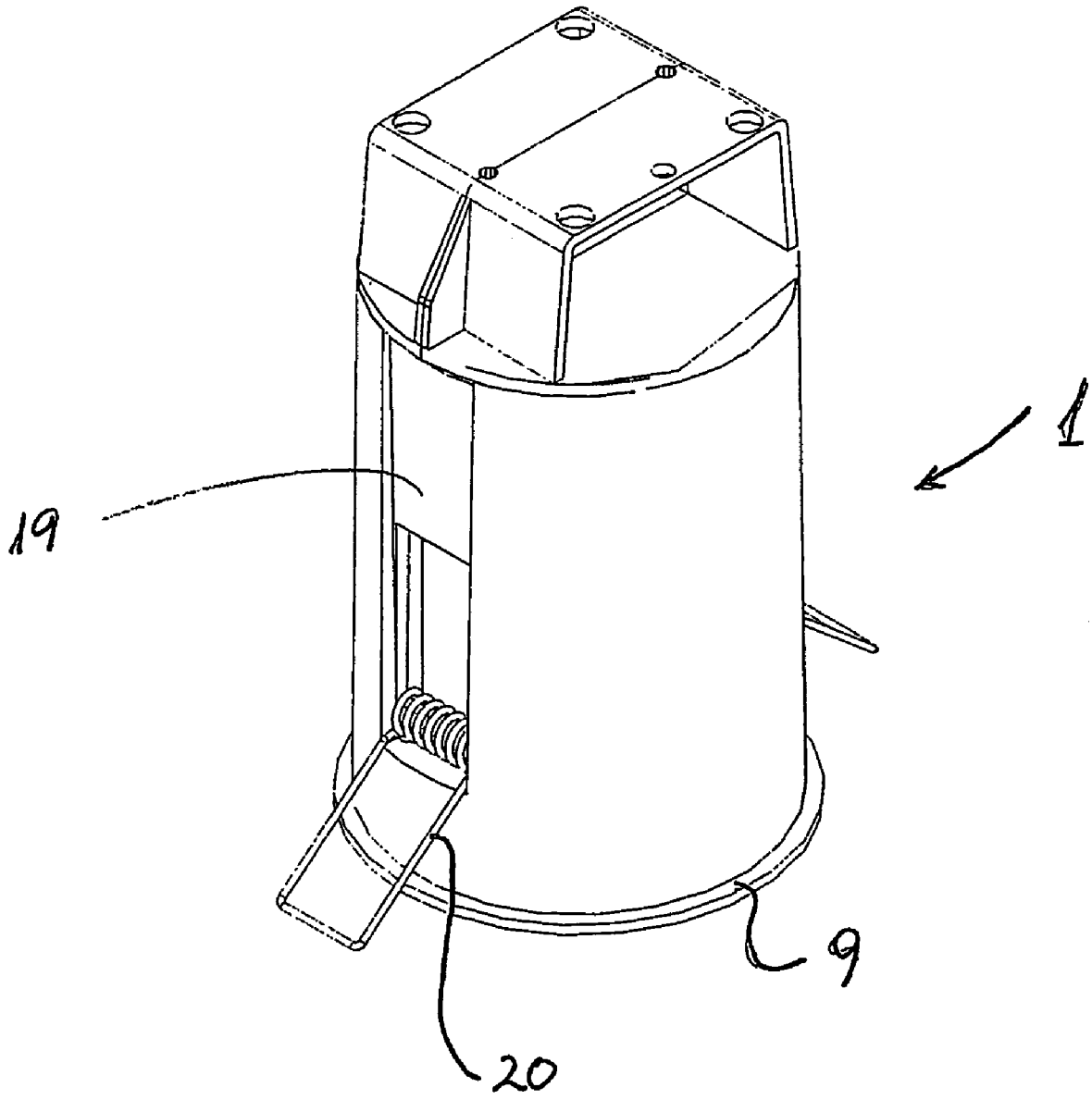
FIG. 7 shows the insert with a still further version of the resilient member.

In FIG. 7 is illustrated a still further embodiment where the pivotable member 20 is made from a steel wire having spring characteristics. The insert functions in the same manner as the insert 1 described above with reference to FIGS. 5 and 6. In the illustration the resilient members 20 are in the position where they should engage the construction element (not shown) into which the insert is to be arranged.

Figure 8:
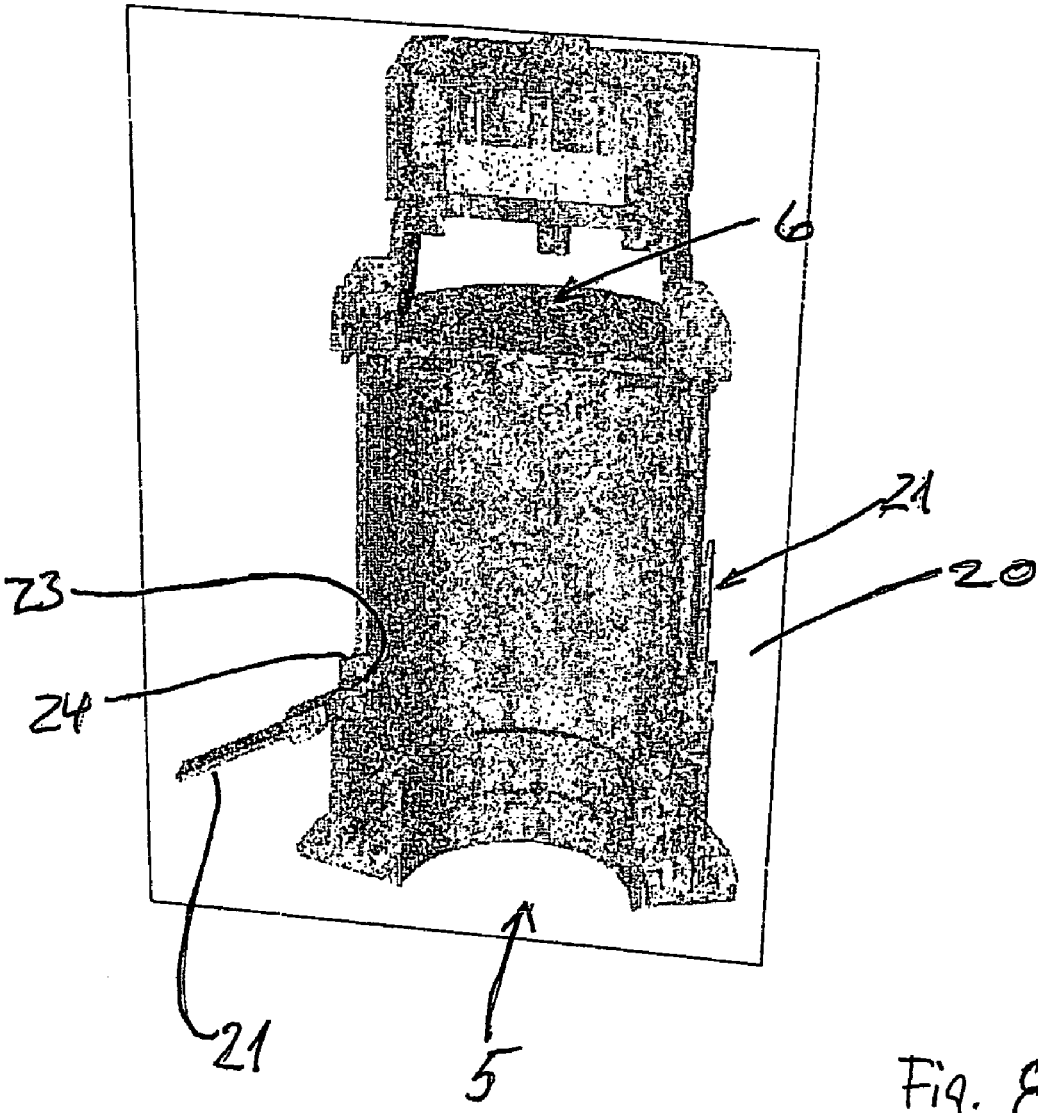
FIG. 8 shows a cross section through an embodiment of the insert.

In FIG. 8 is illustrated a cross-section through an embodiment of the invention. On the right-hand side of the figure the pivotable member 20 is in a position ready for the insert to be mounted, and in the left hand side of the figure the third section 23 has been pivoted for engagement with the slit 24, such that the first section 21 will engage the construction (not shown) in which the insert is arranged. In order to illustrate the orientation of the insert the ventilation means 6 and the aperture 5 has been indicated.

The invention claimed is:

1. Insert suitable for being placed in a wall, ceiling or other element, wherein said insert comprises ventilation means and an aperture in which, inside the insert, means for snap-fitting of electrical installation means, are provided, and that furthermore resilient means are provided for fastening of the insert in said wall, ceiling or other element, wherein the insert is an expansion unit comprising two coaxially arranged cylindrical elements which include at least three zones in axial direction:

a first zone that in the assembled condition will be furthest from the surface on which the item is mounted and at the inner side of which is provided engagement means;

a deformation zone in which there is provided pre-shaped deformation means, whereby the item, when subjected to axial deformation, will expand the cylindrical cross-section compared with the cross-section of the cylinder before the deformation; and a first spacer zone;

further wherein the inner cylindrical element includes at least two zones:

a first zone in which at the outer side of the cylinder there is provided engagement means corresponding to and intended for engagement against the engagement means of the outer cylinder; and a second spacer zone.

2. The insert according to claim 1, characterised in that the end comprises one or more apertures for letting air in or out of the insert.

3. The insert according to claim 1, characterised in that the ventilation means is a ventilator comprising a fan.

4. The insert according to claim 1, characterised in that the side of the end, facing away from the aperture is supplied with distance keeping means.

5. The insert according to claim 1, characterised in that the insert is provided with means for attaching the electrical installation means, and that further means are provided for allowing the air stream created by the ventilation means to pass the electrical installation means.

6. The insert of claim 1, wherein the electrical installation means is coupled to fixtures selected from the group consisting of lamp sockets, connection boxes, halogen lights, fans, and combinations thereof.

7. The insert of claim 3, further comprising a current supply to the electrical installation means.

8. The insert of claim 7, wherein the current supply additionally supplies current to the ventilation means.

9. The insert of claim 4, wherein the distance keeping means is selected from the group consisting of legs, protrusions, netting basket, and combinations thereof.

10. Insert suitable for being placed in a wall, ceiling or other element, wherein said insert comprises ventilation means and an aperture in which, inside the insert, means for snap-fitting of electrical installation means, are provided, and that furthermore resilient means are provided for fastening of the insert in said wall, ceiling or other element, wherein the resilient means comprises one or more members pivotably mounted in the wall of said insert, where each member has a first section, a middle section, and a second section, where a pin is arranged through said middle section and that said pin is pivotably accommodated in the wall of the insert, such that the resilient means may pivot in relation to the insert, and that in a first position the first section is accommodated in a recess provided in the outer surface of said insert wall, and that said second section is exposed inside the insert, and that in a second position the first section extends out from the wall of the insert, preferably towards the aperture end of the insert, and that said second section is releasably but firmly engaged in a slit or recess provided on the inner surface of the insert.

11. The insert according to claim 10, characterised in that the first section comprises a steel blade, and that the rest of the pivotably mounted member is made from a polymer, and that further the pin is made from metal.

12. The insert of claim 11, wherein the steel blade is of spring steel material.

13. The insert of claim 11, wherein the polymer is a plastic material complying with 5VA requirements.

14. The insert of claim 11, wherein the metal is stainless steel.

15. The insert of claim 10, wherein the electrical installation means is coupled to fixtures selected from the group consisting of lamp sockets, connection boxes, halogen lights, fans, and combinations thereof.

* * * * *